United States Patent [19]

Musco

[11] Patent Number: 5,048,708

[45] Date of Patent: Sep. 17, 1991

[54] PACKAGE FOR CYLINDRICAL OR POLYGONAL PACKED BODIES, IN PARTICULAR PLASTIC OR GLASS BOTTLES FOR BEVERAGES, MINERAL WATER AND THE LIKE

[76] Inventor: Ezio Musco, Via Belvedere, 26, 24016 San Pellegrino Terme, Bergamo, Italy

[21] Appl. No.: 506,475

[22] Filed: Apr. 9, 1990

[30] Foreign Application Priority Data

Apr. 14, 1989 [IT] Italy ..... 20153 A/89

[51] Int. Cl.[5] ..... B65D 71/02

[52] U.S. Cl. ..... 220/23.4; 206/428; 206/432; 206/497

[58] Field of Search ..... 53/398; 206/427, 428, 206/432, 442, 446, 497, 805, 150; 220/23.4

[56] References Cited

U.S. PATENT DOCUMENTS

| | | | |
|---|---|---|---|
| 3,460,863 | 8/1969 | Schaich | 206/427 |
| 3,650,395 | 3/1972 | Hobbs | 206/432 |
| 3,930,578 | 1/1976 | Stein | 206/428 |
| 3,946,862 | 3/1976 | Klygis et al. | 206/427 |
| 4,460,084 | 7/1984 | Miller | 206/428 |
| 4,544,194 | 10/1985 | Allen | 206/150 |
| 4,828,110 | 5/1989 | Lems | 206/427 |

FOREIGN PATENT DOCUMENTS

| | | | |
|---|---|---|---|
| 0963855 | 3/1975 | Canada | 206/150 |
| 1206139 | 9/1970 | United Kingdom | 220/23.4 |

*Primary Examiner*—Jimmy G. Foster

*Attorney, Agent, or Firm*—Bucknam and Archer

[57] ABSTRACT

A package for cylindrical or polygonal bodies, in particular plastic or glass bottles for beverages and the like, of the type including a collar projecting under a bottle closure plug, comprises a top strip member which can be arranged, in a closed loop configuration, near the neck of the cylindrical bodies, under the projecting collar, so as to connect a set of bodies to form a pack which can be handled as an unit by using the strip member as a gripper, a coupling bottom member being moreover provided for coupling at the bottom the bodies.

1 Claim, 3 Drawing Sheets

PACKAGE FOR CYLINDRICAL OR POLYGONAL PACKED BODIES, IN PARTICULAR PLASTIC OR GLASS BOTTLES FOR BEVERAGES, MINERAL WATER AND THE LIKE

BACKGROUND OF THE INVENTION

The present invention relates to a package for the packaging and shipment of cylindrical or polygonal bodies, in particular plastic or glass bottles for beverages, mineral water and the like.

As is known, for a proper delivery of beverages, mineral waters, wines and liquid products in general, it is very important to properly package the bottles holding these liquid products, both for facilitating the storing and shipment thereof, and for allowing the user to easily take up and transport the bottles.

Conventionally used packages for plastic bottles, provide for the use of a thermoshrinkable plastic film, which encompasses a given number of bottles arranged in an adjoining relationship in one or more parallel rows, which in turn are arranged according to an orthogonal not offset pattern.

These patterns are generally obtained by packaging either 6 or 12 bottles and, in most cases, they provide for the use of an additional tray member to be arranged under the bottom of the bottles.

These packages are moreover to be provided with at least a gripping member or handle in order to easily grip the thus formed bottle package.

Conventionally used gripping members comprise strip like gripping members which usually encompass the package encompassed by the thermoshrinkable film; such a strip, however, has the drawback that it can be removed with difficulty, since it must be cut, by scissors or the like, as the single bottles are to be used.

Other known solutions provide for the use of a gripping band which is either glued or welded to the package so as to provide a gripping handle.

While this handle can be easily removed, it has the drawback that it is not fully reliable, since it may be accidentally detached.

Another problem affecting the above mentioned gripping means is that of a comparatively high cost of the bottle encompassing thermoshrinkable film, supporting tray element and gripping handle, which adds to the bottle production cost.

Yet another drawback of the mentioned bottle packages is that related to the difficulties of disposing of the packaging plastic material, which disposal is very important from an environmental pollution standpoint.

Finally, yet another drawback of the above mentioned bottle packages is that for thermoshrinking the plastic film there are generally used heating ovens which consume a great amount of electric power.

SUMMARY OF THE INVENTION

Accordingly, the main object of the present invention is to overcome the above mentioned drawbacks by providing a package for cylindrical or polygonal bodies, in particular plastic or glass bottles for beverages, mineral water and the like which is very simple construction-wise, or very reduced weight and size and which, moreover, is provided with high mechanical resistance characteristics.

Another object of the present invention is to provide such a bottle package which comprises a gripping handle which also forms a bottle joining means adapted to hold the bottles in a set arrangement.

Another object of the present invention is to provide such a bottle package which does not provide for the use of thermoshrinkable films and which is adapted to conceal exclusively small regions of the outer surface of the bottles, with the advantage of allowing a person to easily see conventionally applied labels and the like.

Yet another object of the present invention is to provide such a package in which the bottles can also be arranged with an offset arrangement, so as to reduce to a minimum the space requirements for the package.

Yet another object of the present invention is to provide such a package which can be disposed of in a very simple and not polluting way.

According to one aspect of the present invention, the above mentioned objects, as well as yet other objects, which will become more apparent hereinafter, are achieved by a package for cylindrical or polygonal packed bodies, in particular plastic or glass bottles for beverages, mineral water and the like, said bottles being of the type including a projecting neck collar, characterized in that said package comprises a top strip member adapted to be arranged, with a closed loop configuration, at said necks of said bottles near said collars thereof, said top strip member being so designed as to connect a plurality of said bodies so as to form a pack which can be handled through said top strip, said bodies being arranged with an offset arrangement.

BRIEF DESCRIPTION OF THE DRAWINGS

Further characteristics and advantages of the invention will become more apparent from the following detailed description of a preferred embodiment thereof, which is illustrated, by way of an indicative but not limitative example, in the figures of the accompanying drawings, where.

DESCRIPTION OF THE PREFERRED EMBODIMENT

With reference to the figures of the accompanying drawings, the package according to the present invention has been specifically designed for holding a bottle number which can be easily handled by a person, that is within about 10 kg: thus, in the case of plastic bottles of 1 liter and a half, having a weight of about 1.5 Kg, the package will advantageously hold a maximum of seven bottles.

In this connection, it should be pointed out that the package according to the invention can be preferably used for 2, 3, 5 or seven bottles, as it will become more apparent hereinafter.

The mentioned package essentially comprises a top strip member which can be arranged, with a closed loop arrangement, at the necks of a set of bottles, under the projecting collars thereof, as usually provided in this type of bottles; moreover, in order to provide stability to the assembly, there is used a bottom gathering member which is adapted to hold the bottles in an adjoning relationship.

Figure 1:
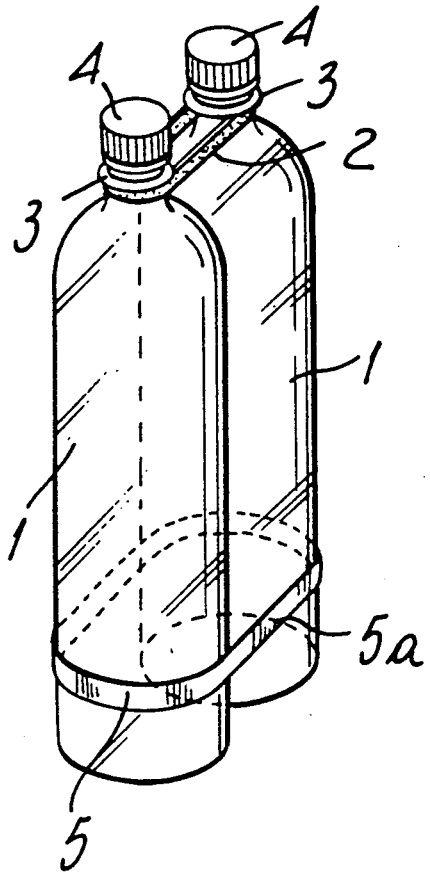
FIG. 1 is a perspective view showing a package provided for holding two plastic material bottles.
Figure 2:
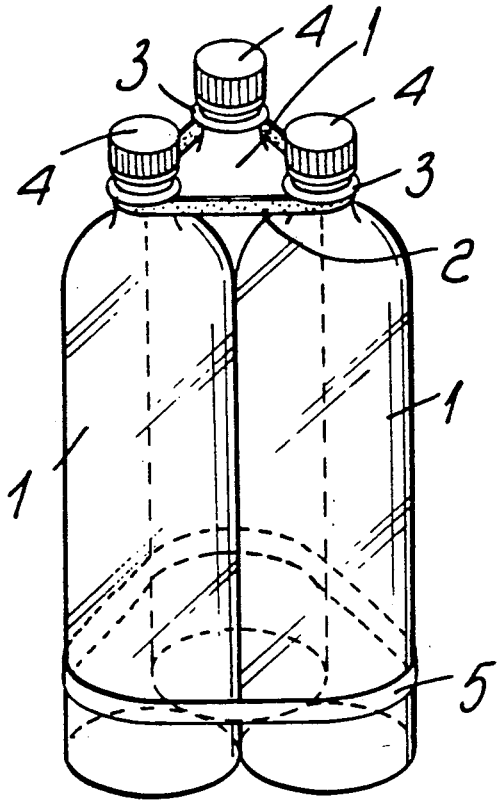
FIG. 2 is another perspective view showing a like package for holding three adjoining plastic material bottles.
Figure 3:
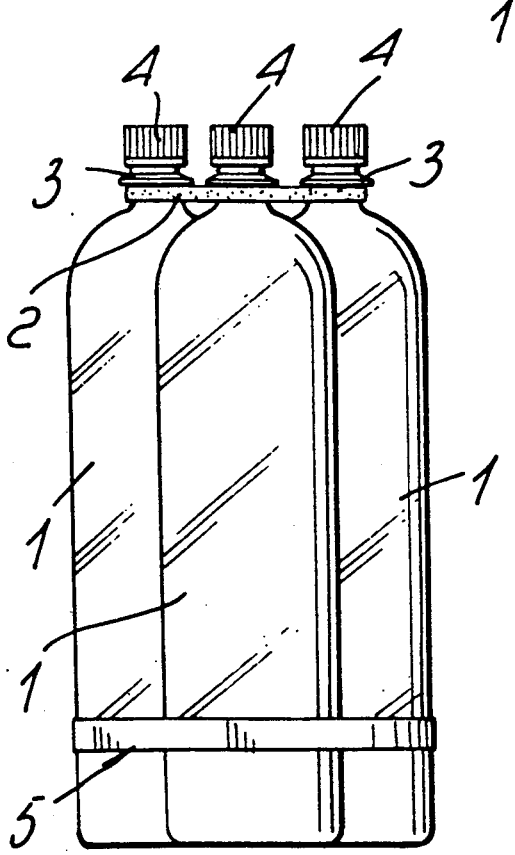
FIG. 3 is a side view showing the package of FIG. 2.
Figure 4:
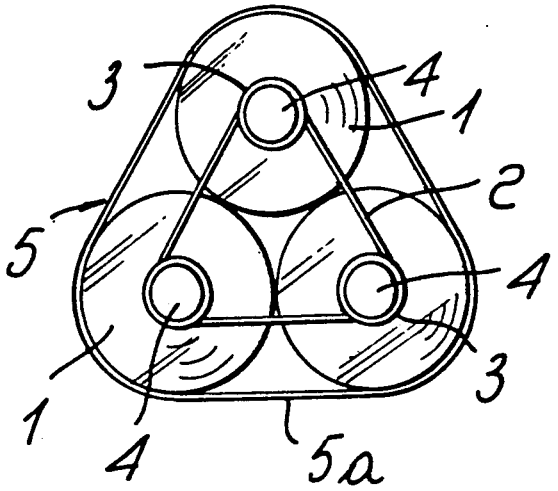
FIG. 4 is a top plan view of the bottle packages shown in FIGS. 2 and 3.

More specifically, with reference to a package holding two like bottles 1, FIG. 1, the top strip member can comprise a web, an adhesive tape, a ring or a thermosealed gripping member which is adapted to form a sort of collar about the necks of the gathered bottles or the collar of vessels of other types.

In each case, the top strip element is so designed as to be firmly housed within grooves provided under the collars 3 of the bottles, in which grooves the strip is either partially or fully engaged under a sufficient tension.

In order to improve the stretching characteristics of the strip member 2 and to provide a bottle package having a good stability, there is provided a bottom fastening arrangement which can be performed about the pheriphery of the bottle package by a bottom strip element 5 which can be stretched during the package clamping step or it can also be made as a closed loop, adapted to be engaged from the bottom of the bottles.

Alternatively said stabilizing bottom element can be made by using a flat sheet of paper, paperboard or plastic materials, said sheet being suitably glued or thermosealed.

Figure 5:
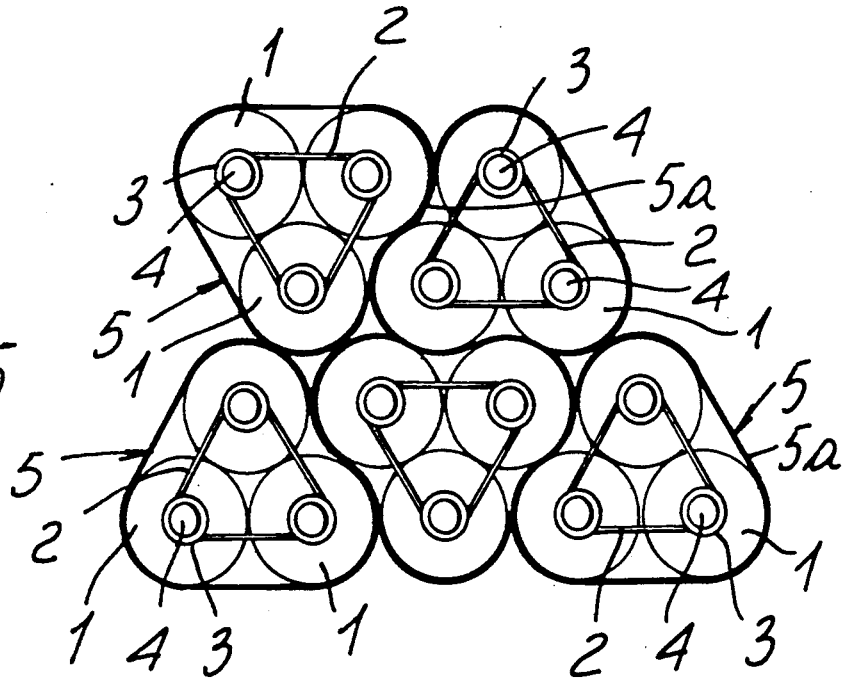
FIG. 5 is a top plan view illustrating several three bottle packages according to the present invention, which are so arranged as to reduce to a minimum the occupied space owing to a great reduction of the empty spaces between the individual bottle packages.

Advantageously, though not necessarily, the strip element 5 is made as a flexible material flat element, at least in part of a resilient nature, in order to allow the portions 5*a* not contacting the bottles to resiliently yield as several packages are arranged near one another, as is shown in FIG. 5.

This would result in a great space reduction, which would be very advantageous from the selling, loading and storing standpoints.

The top strip element and bottom strip element can be formed by thermoshrinkable material straps to which thermomelting adhesive can be preliminarily applied; thus the package holding elements can be simultaneously applied, and the stretching thereof will be carried out during a subsequent step, by a thermal processing adapted to properly assemble the bottles in the package.

Figure 6:
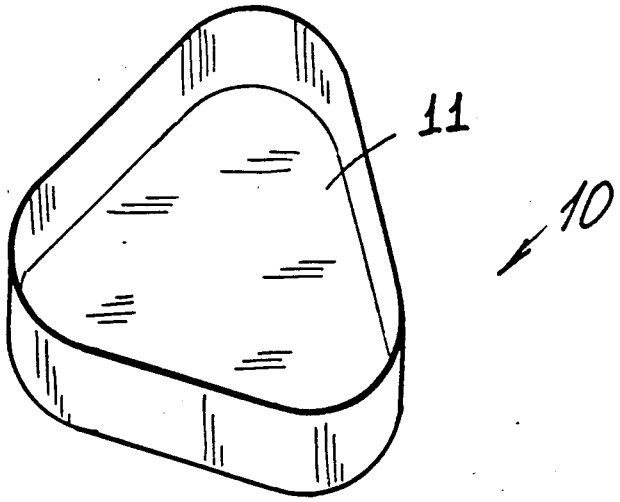
FIG. 6 is a schematic view showing a bottle supporting plate like member.
Figure 7:
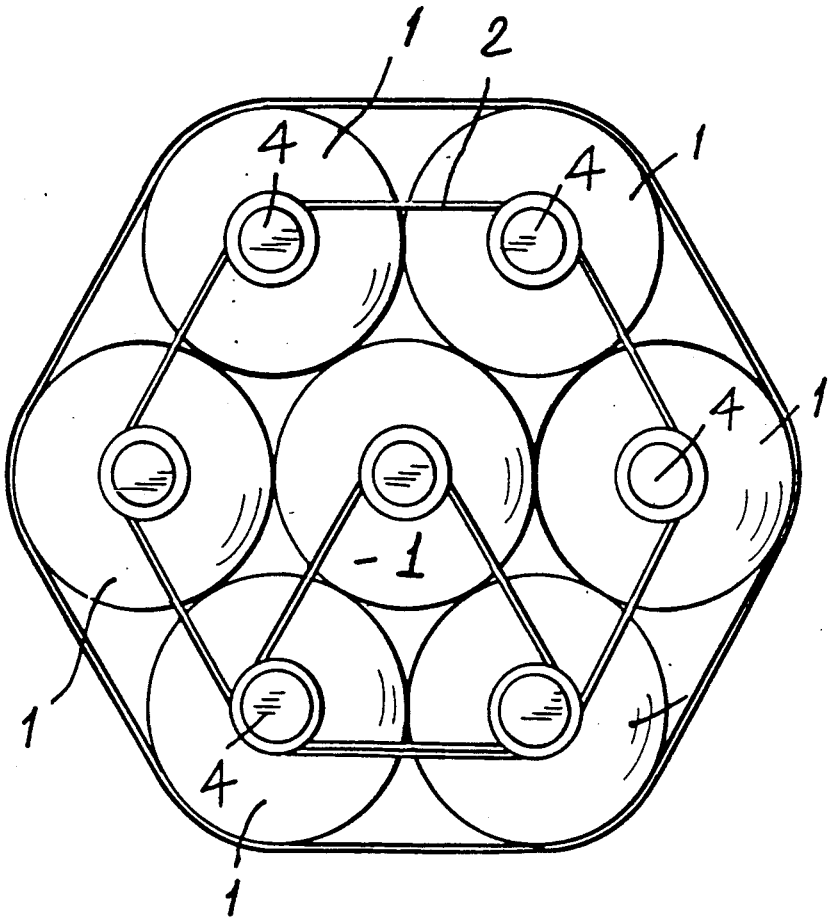
FIG. 7 is another schematic view showing a package holding seven adjoining bottles or vessels.

As is shown in FIG. 6, the bottom stabilizing element, instead of the strip element 5, can comprise a plate 10 which can be provided with recesses 11 for holding the bottoms of the plastic bottles in an adjoining relationship.

Likewise, the gathering element can be coupled to the bottle bottoms by means of glues or thermosealing materials.

A main feature of the present invention is that the top strip element, which is in a stretched condition, in addition to operating as a bottle gathering and packaging element, also provides a good gripping handle for gripping the bottle package, since it can be easily gripped at the free portions of the strip like element 2 which are stretched between the bottles.

This handle element can also operate as a tearing element for disengaging the single bottles from the package at the use time.

On the stabilizing bottom elements 5 or 10, moreover, indicating marks can be impressed, as well as a bar code for indicating the commercial use of the package.

Moreoever, the strip element can also be formed with eyelets elements or the like for facilitating the gripping, said strip element being susceptible to be easily centered with respect to the package.

The fact should be moreover pointed out that the disclosed package can be made by simple apparatus, with a very reduced amount of packaging material which, in actual practice, will correspond to the top strip element and the bottom stabilizing element.

From the above disclosure, it should be apparent that the invention fully achieves the intended objects.

While the invention has been disclosed and illustrated with reference to a preferred embodiment thereof, it should be apparent that the disclosed embodiment is susceptible to several modifications and variations all of which will become within the spirit and scope of the appended claims.

I claim:

1. A package for packaging a plurality of bottles comprising a closed loop top strip member adapted to be arranged, with a closed loop configuration, about neck portions of said bottles near collar portions thereof, to connect a plurality of said bottles so as to form a pack which can be gripped by said top strip member, a further closed loop bottom resilient strip element being moreover provided for encompassing said bottles and holding said bottles in an adjoining offset arrangement, said top strip member comprising a closed loop member of a material to be stretched about said neck portions of said bottles arranged with an adjoining clamped relationship, said top strim member being thermosealed on said neck portions, and said top and bottom strip members comprising thermoshrinkable straps including thermosealing adhesive coating materials.

* * * * *